United States Patent [19]

Frank

[11] 4,225,857

[45] Sep. 30, 1980

[54] SPRING LOOP DOOR AND WINDOW ALARM SWITCH

[76] Inventor: Karl F. Frank, 1218 Casedale St., Leigh Acres, Fla. 33936

[21] Appl. No.: 939,839

[22] Filed: Sep. 5, 1978

Related U.S. Application Data

[63] Continuation-in-part of Ser. No. 827,848, Aug. 26, 1977, abandoned.

[51] Int. Cl.[2] ..... G08B 13/08

[52] U.S. Cl. ..... 340/545; 200/61.74; 200/61.76; 200/61.93; 340/546

[58] Field of Search ..... 340/545, 546; 200/61.78, 61.76, 61.74, 61.93

[56] References Cited

U.S. PATENT DOCUMENTS

| | | | |
|---|---|---|---|
| 423,753 | 3/1890 | Gee | 340/545 |
| 627,192 | 6/1899 | Johnson | 200/61.74 |
| 798,803 | 9/1905 | Kreh | 200/165 |
| 1,305,190 | 5/1919 | Bobo | 340/546 |
| 3,597,555 | 8/1971 | Gould | 200/61.93 |

*Primary Examiner*—Glen R. Swann, III

*Attorney, Agent, or Firm*—James P. Malone

[57] ABSTRACT

A strip of conductive spring material is formed in a loop with extending ends adapted to be clamped together by closed doors and windows. In one embodiment, a conductive rod member has a hook at one end, the other end of the rod member being fixedly connected to one side of the loop, the hooked end extending through a hole in the other side of the loop. An apertured contact member is mounted on and insulated from the outside of the other side of the loop. The loop is unclamped when the door or window is opened and a circuit is completed between the hooked end and the contact. In another embodiment, the loop is positioned between two stationary contacts, being permanently attached to the first one of the contacts. When the extended ends are clamped, the loop does not touch the second contact, but when the ends are unclamped, the loop bridges the two fixed contacts to complete an alarm circuit.

6 Claims, 8 Drawing Figures

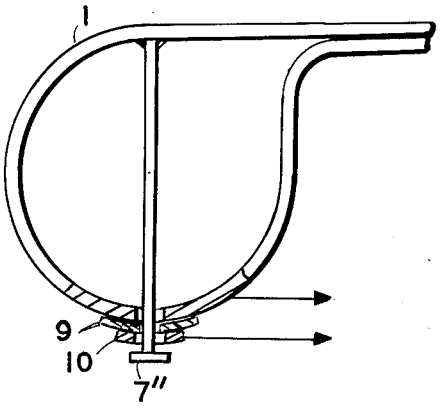
FIG 1A
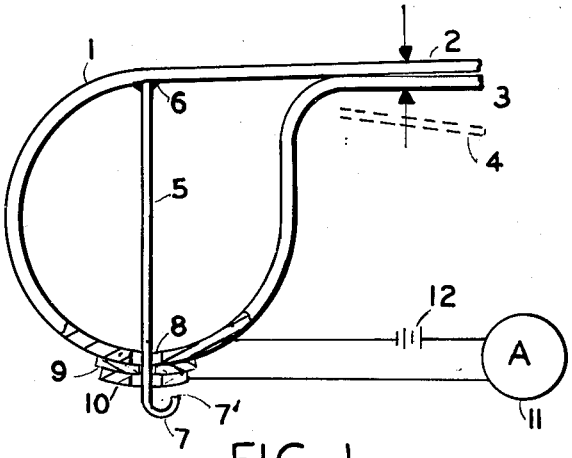
FIG 1
FIG 2
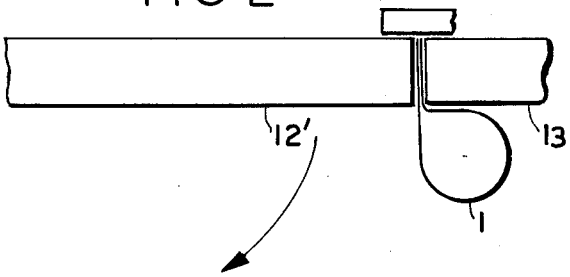
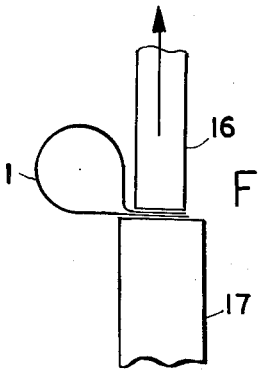
FIG 5
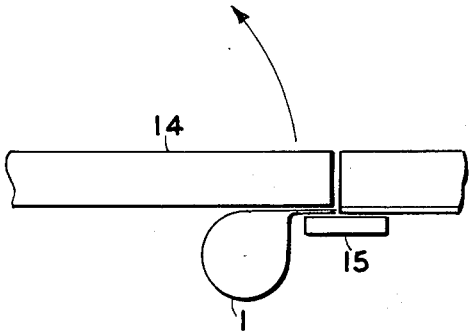
FIG 3
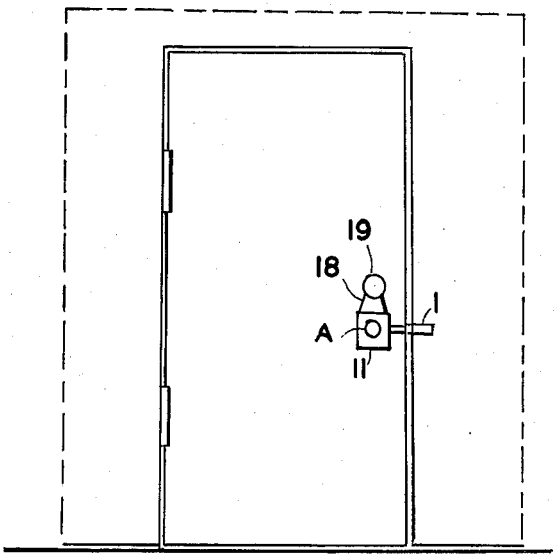
FIG 4

SPRING LOOP DOOR AND WINDOW ALARM SWITCH

This Application is a continuation-in-part of application Ser. No. 827,848, filed Aug. 26, 1977, now abandoned.

BACKGROUND

This invention relates to portable door and window burglar alarms which can be used by travelers and can be attached to any door or window and more particularly to a switch adapted to be clamped by a closed door or window and which opens when the door or window is opened.

There is a need for door and window alarm means which are portable, reliable and inexpensive. The present invention provides a switch which is held clamped between a closed door or window and a door or window frame. When the door or window is opened the switch is unclamped and makes contact thereby sounding the alarm.

Accordingly, the principal object of the invention is to provide new and improved burglar alarm means.

Another object of the invention is to provide new and improved burglar alarm means for doors and windows.

Another object of the invention is to provide a new and improved switch adapted to be clamped by doors and windows.

Another object of the invention is to provide new and improved alarm switches which are reliable and inexpensive.

These and other objects of the invention will be apparent from the following specification and drawings of which:

BRIEF DESCRIPTION OF THE FIGURES

FIG. 1 is a side view of an embodiment of the invention.

FIG. 1A is a side view of another embodiment of the invention.

FIGS. 2, 3 and 5 are diagrams illustrating the use of the invention.

FIG. 4 is a diagram illustrating how the invention is mounted on a door.

DESCRIPTION OF PREFERRED EMBODIMENTS

Figure 6:
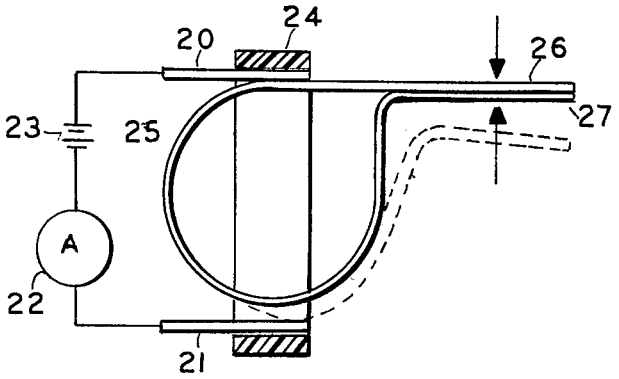
FIG. 6 is a side view of another embodiment of the invention.

Referring to the figures, the invention comprises a switch. The switch comprises a loop 1, of conductive thin strip material having extending straight ends 2 and 3. The loop may be of phosphor-bronze or steel or any other spring like material. The loop is stressed so that it will normally be in the open position shown by the dotted lines 4. Therefore, when in use, the extending ends 2 and 3 are clamped together by inserting them between a door and the door frame or the window or window frame. A conductive rod member 5 is fixedly connected to the loop at point 6. The other end of the rod member having a hook 7 extends through an aperture 8 in the loop. The rod member also extends through an insulating strip 9 which is mounted on the loop. On top of the insulating strip 9 is mounted a contact member 10. Therefore when the extended ends 2 and 3 are unclamped by opening the door or window, then the loop will assume the position illustrated by the dotted lines 4 and contact will be made between the end 7' of the hook 7 and the contact member 10.

An alarm 11 has one terminal connected through battery 12 to the loop 1. The other terminal of the alarm 11 is connected to the contact member 10. Therefore, when contact is made by the end of the hook 7, the alarm will be sounded.

FIG. 1A shows a modification of the invention having a cap 7'' instead of hook 7.

FIG. 2 shows how the loop 1 is mounted between a door 12' and the door frame 13 where the door opens in the direction of the arrow. The loop is held by the closed door and when the door is opened the loop 1 will expand causing contact to be made and the alarm sounded.

FIG. 3 shows another arrangement where the loop 1 is clamped between a door 14 and a door stop 15, where the door opens in the direction of the arrow.

FIG. 5 shows how loop 1 is clamped between a window 16 and a window frame 17. FIG. 4 illustrates how the alarm 11 and the loop switch 1 may be mounted on a door by means of a loop 18 of material which is hung on the door knob 19.

As illustrated in FIG. 4, the entire device is small, light and easily portable. The device may incorporate a conventional buzzer or other alarm which has battery power. The device of the present invention is reliable, inexpensive and requires no installation except inserting the extended ends of the loop between the door and the door frame or between the window and window frame. When the alarm is not in use the loop ends may be clamped together with a paper clip.

Figure 6A:
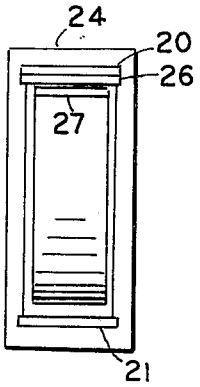
FIG. 6A is an end view of FIG. 6.

FIGS. 6 and 6A show another embodiment of the invention having a first fixed position contact 20, mounted on a bracket 24, and a second fixed position contact 21, mounted on the bracket 24. These contacts are connected in series with an alarm 22 and a battery 23. A curved conductive member 25 is fixedly connected to the contact 20. The ends 26 and 27 of the curved member 25 are adapted to be held together, for instance, by a closed window or door.

When the door or window is opened, the ends 26 and 27 spring apart so that the curved conductive member 25 comes in contact with the contact 21 thereby completing the alarm circuit through the alarm 22. The curved conductive member may be made of any springy material such as spring steel and the bracket 24 is made of insulating material, such as plastic.

It is claimed:

1. Door and window switch alarm means comprising, a strip of conductive spring material formed in a loop with extending ends adapted to be clamped together by closed doors and windows, a conductive rod member having a first contact at one end, the other end of said rod member being fixedly connected to one side of the loop, the contact end extending through a hole in the other side of the loop, an apertured second contact member mounted on and insulated from the outside of the other side of the loop, whereby the loop is unclamped when the door or window is opened and a circuit is completed between the first and second contacts.

2. Apparatus as in claim 1 having an alarm connected to said loop and said contact.

3. Apparatus as in claim 2 having means to hang the alarm on a door knob.

4. Apparatus as in claim 1 wherein the first contact is a hook.

5. Apparatus as in claim 1 wherein the first contact is a cap.

6. Door and window switch means comprising:

a first fixed position contact, a second fixed position contact, a curved conductive strip member, the ends of which are adapted to be held together but which spring apart when the hold is released, the curved member being permanently connected to the first contact, the curved member being adapted to make contact with the second contact when the hold is released, whereby the ends of the curved member may be clamped together by a closed door or window.

* * * * *